US005501266A

United States Patent [19]

Wang et al.

[11] Patent Number: 5,501,266

[45] Date of Patent: Mar. 26, 1996

[54] METHOD AND APPARATUS FOR INJECTION MOLDING OF SEMI-SOLID METALS

[75] Inventors: Kuo K. Wang; Hsuan Peng; Nan Wang; Shau-Poh Wang, all of Ithaca, N.Y.

[73] Assignee: Cornell Research Foundation, Inc., Ithaca, N.Y.

[21] Appl. No.: 259,625

[22] Filed: Jun. 14, 1994

[51] Int. Cl.[6] ..... B22D 17/00; B22D 23/00; B22D 27/08

[52] U.S. Cl. ..... 164/113; 164/71.1; 164/312; 164/900

[58] Field of Search ..... 164/900, 71.1, 164/113, 312

[56] References Cited

U.S. PATENT DOCUMENTS

| | | |
|---|---|---|
| 3,902,544 | 9/1975 | Flemings et al. . |
| 4,537,242 | 8/1985 | Pryor et al. . |
| 5,040,589 | 8/1991 | Bradley et al. . |
| 5,144,998 | 9/1992 | Hirai et al. . |

FOREIGN PATENT DOCUMENTS

| | | | |
|---|---|---|---|
| 1-178345 | 7/1989 | Japan | 164/900 |
| 1-170565 | 7/1989 | Japan | 164/900 |
| 1-192447 | 8/1989 | Japan | 164/900 |

OTHER PUBLICATIONS

Metz, S. A. et al, "A Fundamental Study of Hot Tearing", AFS Transactions, vol. 78, pp. 453–460, 1970.

Spencer, D. B. et al, "Rheological Behavior of Sn–15 % Pb in the Crystallization Range", Metallurgical Transactions, vol. 3, pp. 1925–1932, 1972.

Flemings, M., et al, "Rheocasting", Materials Science and Engineering, vol. 25, pp. 103–117, 1976.

Tisier, A., et al, "Magnesium Rheocasting: A study of Processing–Microstructure Interactions", Journal of Materials Science, vol. 25, No. 2B, pp. 1184–1196.

Wang, N., et al., "Formation and Growth of Solid Particles in Shear Flow", Journal of Materials Science, vol. 25, pp. 2185–2197, 1990.

*Primary Examiner*—Kuang Y. Lin

*Attorney, Agent, or Firm*—Barnard, Brown & Michaels

[57] ABSTRACT

A new method and apparatus for the injection molding of semi-solid materials (SSM). In this process (called Rheomolding), a superheated liquid metal is cooled into the semi-solid state in the barrel of a special vertical injection-molding machine, with the growing dendrites of the solid phase being broken into small and nearly spherical particles by the shearing force generated by the screw and barrel. Compared with the superheated liquid metal, SSM has lower temperature, lower shrinkage and a more stable flow pattern. Therefore, the rheomolding process can produce net-shape metal or metal-matrix-composite parts continuously at lower cost.

19 Claims, 8 Drawing Sheets

Figure 6: Flowchart of Rheomolding Process

60

Step 1
Fill

Allow molten metal to flow from hopper into shearing barrel

Shut off flow of molten metal when desired amount has filled area around screw

61

Step 2
Blend

Screw rotates without retraction

Material is cooled below liquidus temperature

62

Step 3
Load

Screw rotates and retracts

Material fills accumulation zone between screw and nozzle

63

Step 4
Inject

Open valve in nozzle

Screw rotates and pushes toward nozzle to inject material into mold

METHOD AND APPARATUS FOR INJECTION MOLDING OF SEMI-SOLID METALS

ACKNOWLEDGMENT OF GOVERNMENT SUPPORT

This invention was made with Government support under Grant Nos. DDM-8815855 and DMI-9412196, awarded by the National Science Foundation. The government has certain rights in the invention.

FIELD OF THE INVENTION

The invention pertains to the field of injection molding. More particularly, the invention pertains to molding of semi-solid or rheological materials as classified by the Patent Office in Subclass 164/900.

BACKGROUND OF THE INVENTION

In the conventional die-casting process, the liquid metal is usually forced into the cavity at such a high speed that the flow becomes turbulent or even atomized. As a result, air is often trapped within the cavity, leading to high porosity in the part which reduces the part strength and can cause part rejection if holes appear on the surface after machining. Moreover, parts with high porosity are unacceptable because they usually are not heat-treatable, thus limiting their potential applications; further, voids can alter the natural frequency of the parts randomly, thus yielding unpredictable vibrational and/or acoustic performances.

Intuitively, the porosity due to turbulent or atomized flow could be eliminated if the viscosity of the metal flow could be increased to reduce the Reynolds number sufficiently so that laminar flow could be produced and the amount of trapped air be minimized, somewhat similar to the injection molding of plastics. However, it was not clear how this could be achieved until the early 1970s when Metz and Flemings proposed the concept of semi-solid material (SSM) processing (Metz, S. A. and Flemings, M. C., "A Fundamental Study of Hot Tearing", *AFS Transactions,* vol 78, pp.453–460 [1970]). They suggested that, if metal solidification is carded out in semi-solid state, the maximum die temperature can be reduced significantly.

The pioneering study of Spencer et al. (Spencer, D. B., Mehrabian, R., and Flemings, M. C., "Rheological Behavior of Sn-15% Pb in the Crystallization Range," *Metallurgical Transactions,* vol. 3, pp. 1925–1932 [1972]) showed that when molten metal is agitated during cooling below its liquidus temperature, the dendritic primary solids will be broken into near-spherical particles suspended in the liquid metal matrix. The viscosity of such a semi-solid slurry increases exponentially with the solid fraction, and it exhibits a shear thinning behavior.

Some die-casting-like manufacturing processes for SSM have been proposed in the past two decades, as shown in Table 1.

Flemings, et. at., received a number of patents on this process, including U.S. Pat. No. 3,902,544, "Continuous Process for Forming an Alloy Containing Non-Dendritic Primary Solids", issued in 1975. This patent is primarily directed at the production of the alloy, although it is indicated that the resulting metal will be removed from the agitation zone and cast.

Flemings et al. (Flemings, M. C., Riek, R. G. and Young, K. P., "Rheocasting", *Materials Science and Engineering,* vol. 25, pp.103–117 [1976] prepared SSM slurry separately and poured it into the shot chamber of a die-casting machine (Rheocasting), where the SSM was injected into the die cavity by a plunger.

Tissier et at. (Tissier, A., Apelian, D., and Regazzoni, G., "Magnesium Rheocasting: A study of Processing-Microstructure Interactions", *Journal of Materials Science*, vol.25, no.2B, pp.1184–1196 [1990]) reported that porosity could still be high in rheocasting since the semi-solid slurry is exposed to the air during stirring at low solid fraction. Furthermore, the plunger mechanism of a die-casting machine does not provide appropriate agitation which is necessary to prevent the formation of a dendritic skeleton, and the high injection speed can introduce mixing of the air with the material in the chamber.

Thixocasting (Flemings et at., "Rheocasting", cited above 8 1976]) is a modification of the Rheocasting process; the material is first rheocast as a billet, cut to appropriately sized slugs and then remelted back to the solid-liquid state for die casting. However, Thixocasting is a two-step process and requires feed materials to be prepared in a separate process, making the operation more costly because of the high cost and low availability of premium billets or powders for SSM processing.

Thixomolding is a different approach where magnesium pellets or particles are fed into a screw injection machine where the chips are convened into SSM slurries by heating and shearing (Bradley, N. L., Wieland, R. D, Schafer, W. J., and Niemi, A. N., U.S. Pat. No. 5,040,589, 1991). However, although porosity might be reduced compared to pressure die casting, it cannot be eliminated and will still be a problem because air (or inert gas) will enter the barrel with the pellets and become a source of porosity in the part. Also, the feed material must be in chip or granular form; thus, if the raw material is in the form of a bar, plate or ingot, a pre-process cutting step is required. Excessive wearing may also occur since the screw is in direct contact with the solid pellets near the feed throat.

Pryor, et. al., U.S. Pat. No. 4,537,242 (1985), presents a "Method and Apparatus for Forming a Thixoforged Copper Base Alloy Cartridge Casing". Like the other Thixo-processes, the SSM is first formed, then cast (solidified) and heated to remelt it in the casting process.

Hirai, et.al., U.S. Pat. No. 5,144,998 (1992) is for a "Process for the Production of Semi-Solidified Metal Composition," Hirai is primarily directed to controlling the solid fraction of the resulting mixture by controlling shear rate of a rod type agitator.

TABLE 1

Various approaches for die-casting-like SSM forming processes

| Process | Feed material | Conditions in the barrel | Comparisons |
|---|---|---|---|
| Rheocasting (Flemings '544) | SSM produced from a separate slurry producer | Constant temperature No shear | 2-step (requires slurry producer) |
| Thixocasting (Flemings 1976) | Partially remelted SSM slugs | Constant temperature No shear | 2-step (requires SSM billets or ingots) |
| Thixomolding | Metal | Heating/shear | 1-step |

TABLE 1-continued

| Various approaches for die-casting-like SSM forming processes | | | |
|---|---|---|---|
| Process | Feed material | Conditions in the barrel | Comparisons |
| (Bradley '589) | pellets | | |
| Rheomolding (this invention) | Liquid metal | Cooling/shear | 1-step |

Although the concept of semi-solid processing seems promising, the major problem remains as how the slurry producing and forming processes can be carded out efficiently. The possibility of getting premature freezing in the mold is higher due to the high solid fraction and high thermal conductivity of the slurry since the viscosity of a semi-solid metal is highly temperature-sensitive, the process control and mold design of SSM die casting are expected to be more difficult than in the conventional die-casting process. In this regard, numerical predictions have been proven to be very helpful for cost and time reduction for plastic injection molding. Nevertheless, due to the coupled non-linearity of the moving free surface and the inertial effects of SSM, only very limited experimental results and numerical procedures are available for the flow analysis.

SUMMARY OF THE INVENTION

The invention presents a novel method and apparatus for producing netshape and porosity-free metal parts from semi-solid materials (including metallic alloys and metal matrix composites). The basic idea is to change the traditional die casting (a near-net-shape process) into an injection molding process (a net-shape process) for metals. Since this approach can be viewed as using an injectionmolding machine to integrate the two steps (slurry producing and die casting) in the Rheocasting process, we name this process as "Rheomolding" and our invented machine as a "Rheomolding machine". The invention will, we expect, have great impact on the die-casting industry and may make the traditional die-casting process obsolete.

In rheomolding, molten metal is fed into a specially designed injection-molding machine (FIG. 1) and is cooled down in the barrel while shearing is applied to the material by the rotating screw. The hopper, charged with shielding gas to prevent the material from oxidation, is heated with the band heaters to keep the feed material in the molten state. The vertical-clamping/vertical-injection configuration has been chosen to minimize the gravity effect of metals because it was found that horizontally injected materials sank to the bottom of the die and filled the cavity bottom up, leading to an inertial-effect-dominated flow pattern which will cause a serious asymmetry of the filling and cooling, thus affecting the mechanical properties of the final part.

Although this process requires the feed material to be completely molten, it in fact may be more economically effective because it has the following advantages:

1. The feed material to the rheomolding machine is in the liquid state, having been melted from the ingot, bar or recycled material; this saves the cost of expensive metal powders or preformed SSM billets, or the time and energy input of cutting ingots into pellets or chips.
2. Since the molten metal in the hopper has low viscosity and high density, air in the hopper and the barrel will escape fast and smoothly during the machine warm-up stage from the top of the hopper because of the large buoyancy in the molten metal in the vertical machine.
3. The process in one-step and relatively simple; it can be fully automated as it is in the plastics industry.

BRIEF DESCRIPTION OF THE DRAWING

FIG. 6 shows a flowchart of the steps of the method of the invention

FIGS. *7a–7c* show the microstructure of the rheomolded Sn-15% Pb alloy with different solid fractions.

Figure 8:
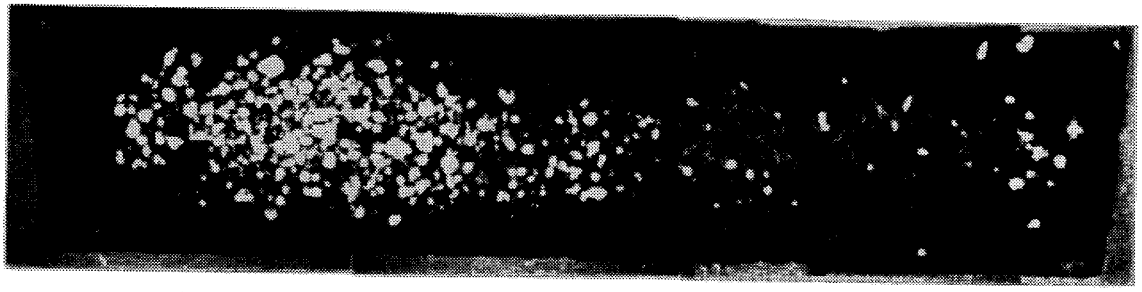

FIG. 8 shows the microstructure of the rheomolded Sn-15% Pb alloy in the cross section of a spiral mold as used in the example.

Figure 9:
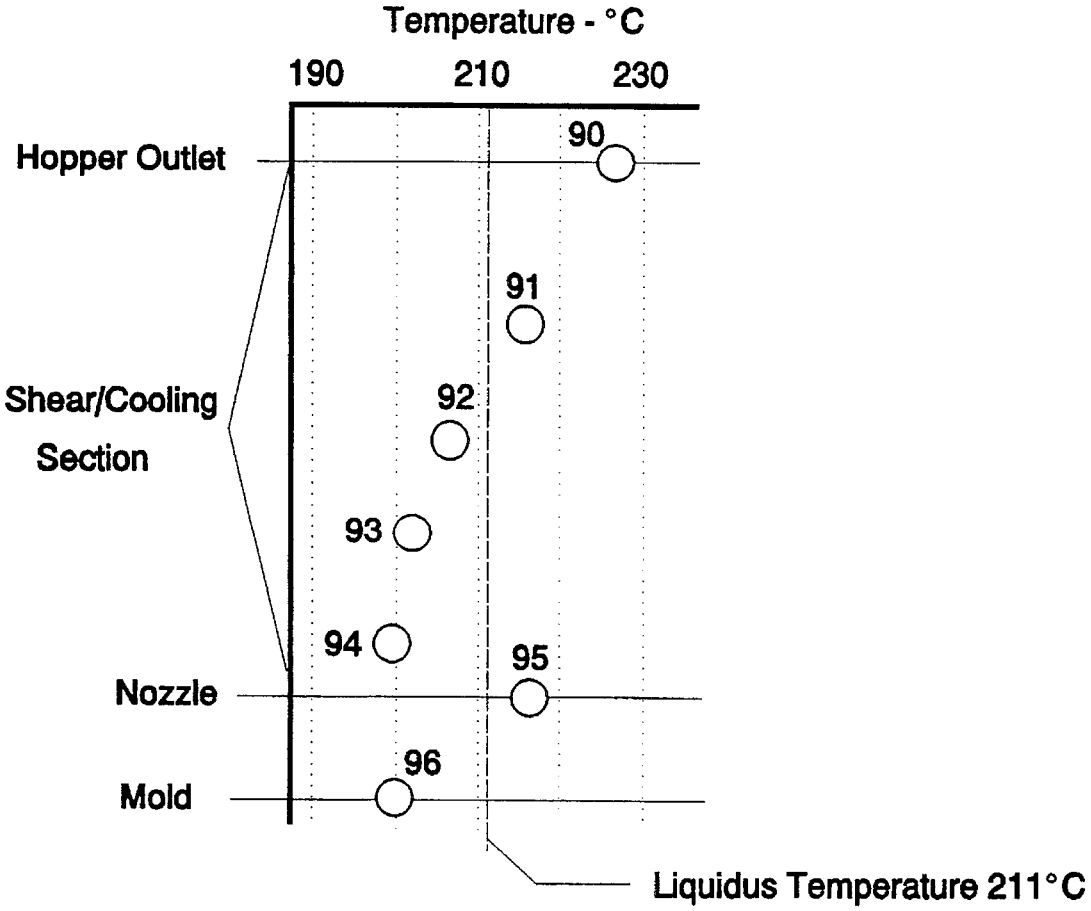
Figure 7A:
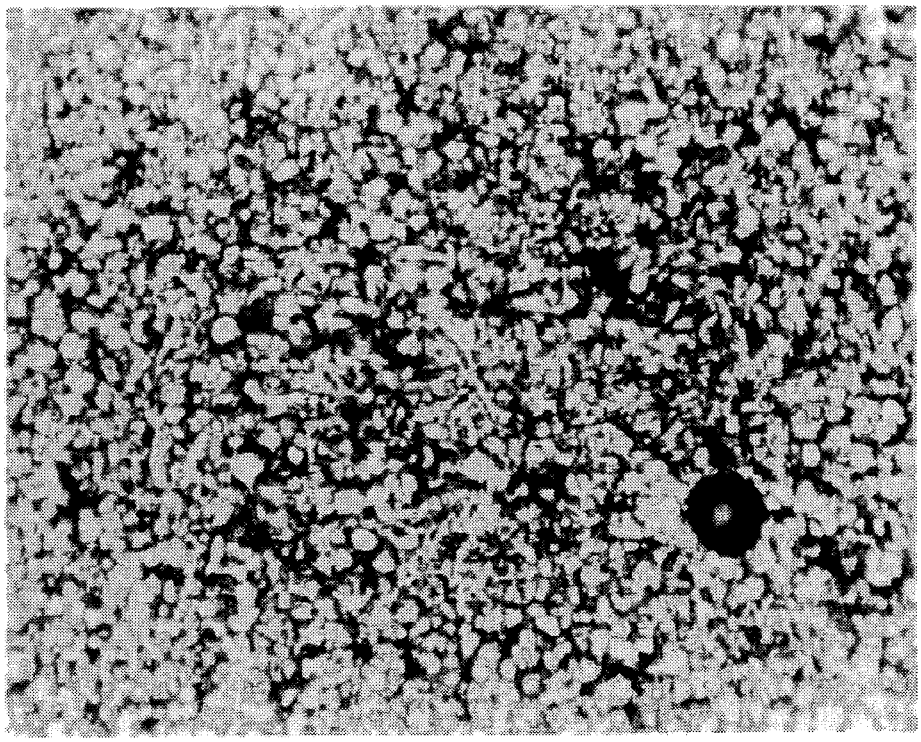
Figure 7B:
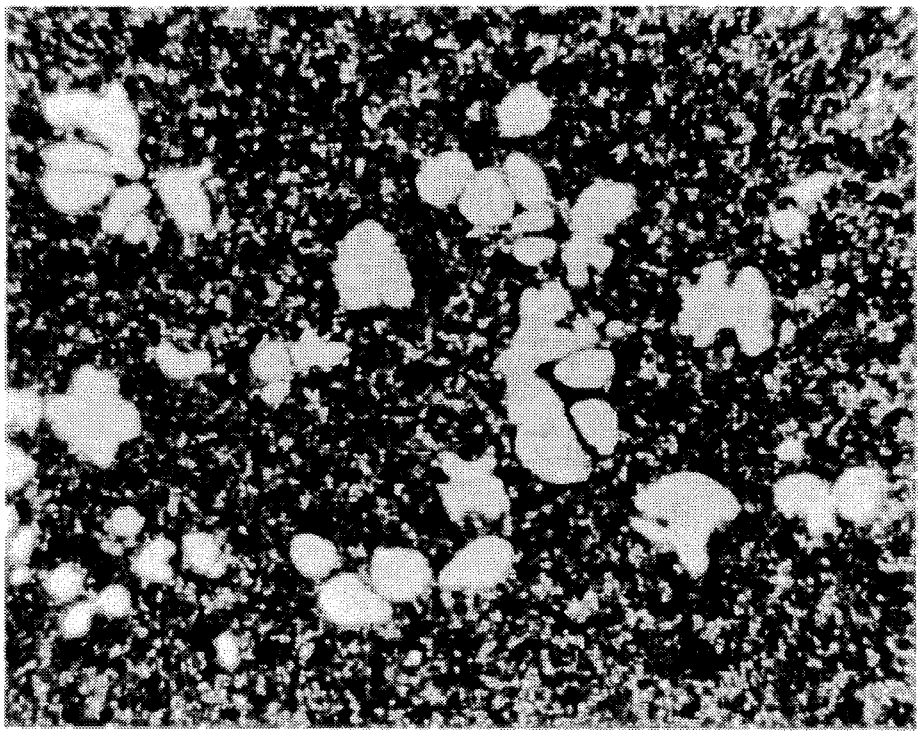
Figure 7C:
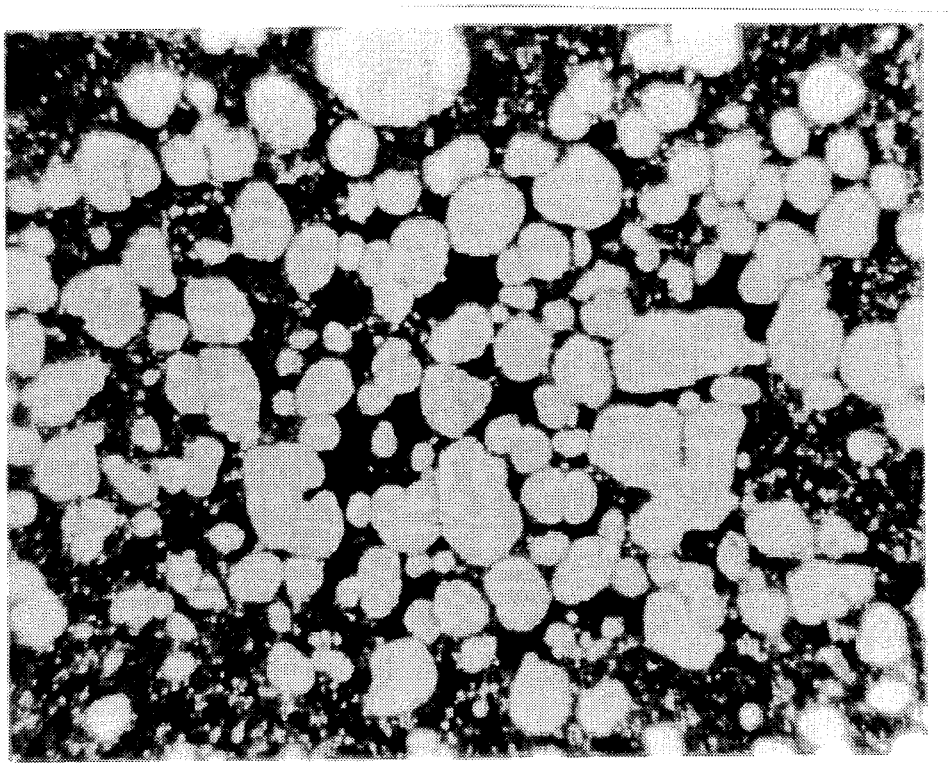

FIG. 9 shows a temperature profile for the material in the apparatus.

DESCRIPTION OF THE PREFERRED EMBODIMENT

Figure 1:
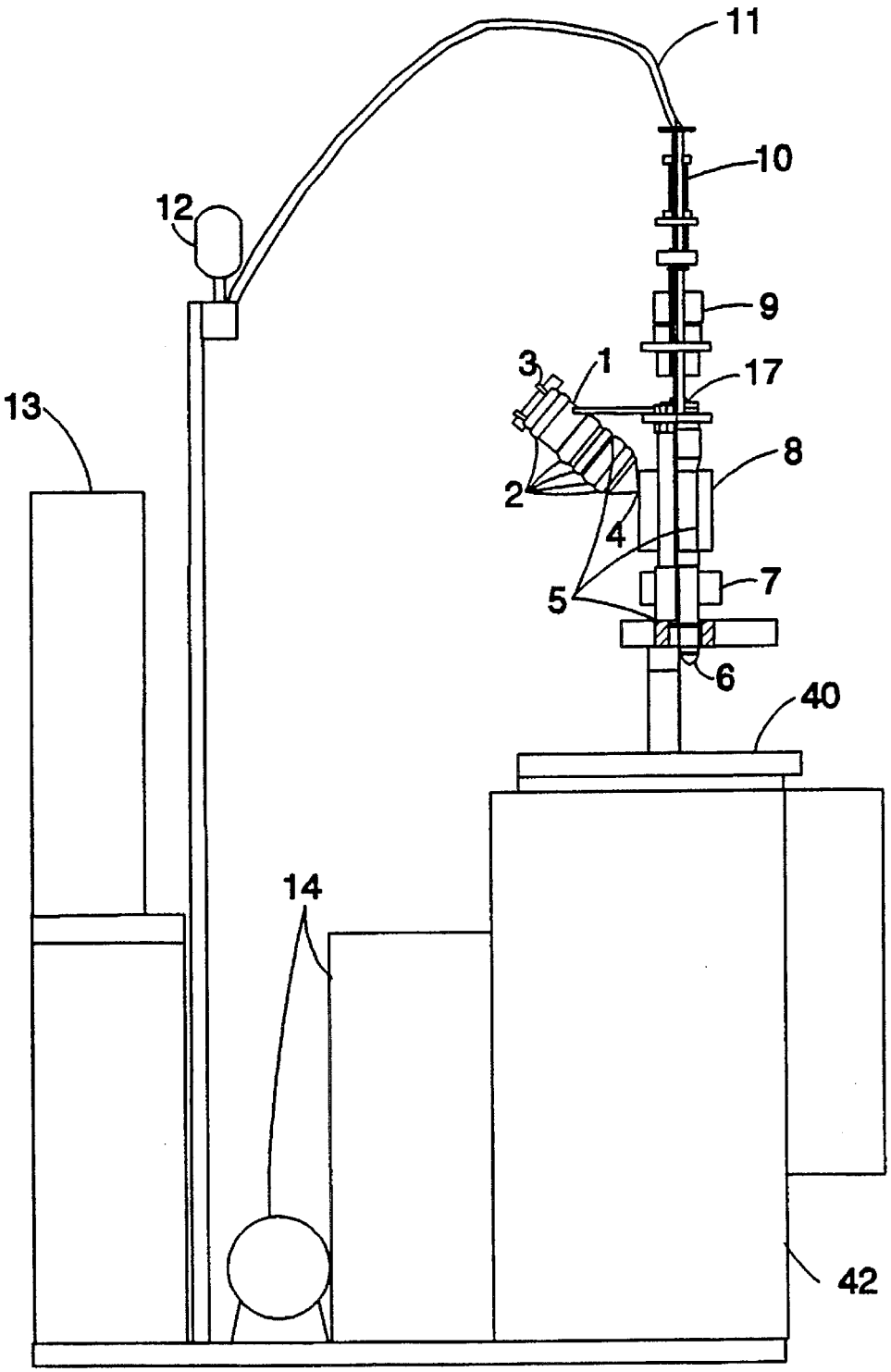
FIG. 1 shows a side view of the apparatus of the invention
Figure 2:
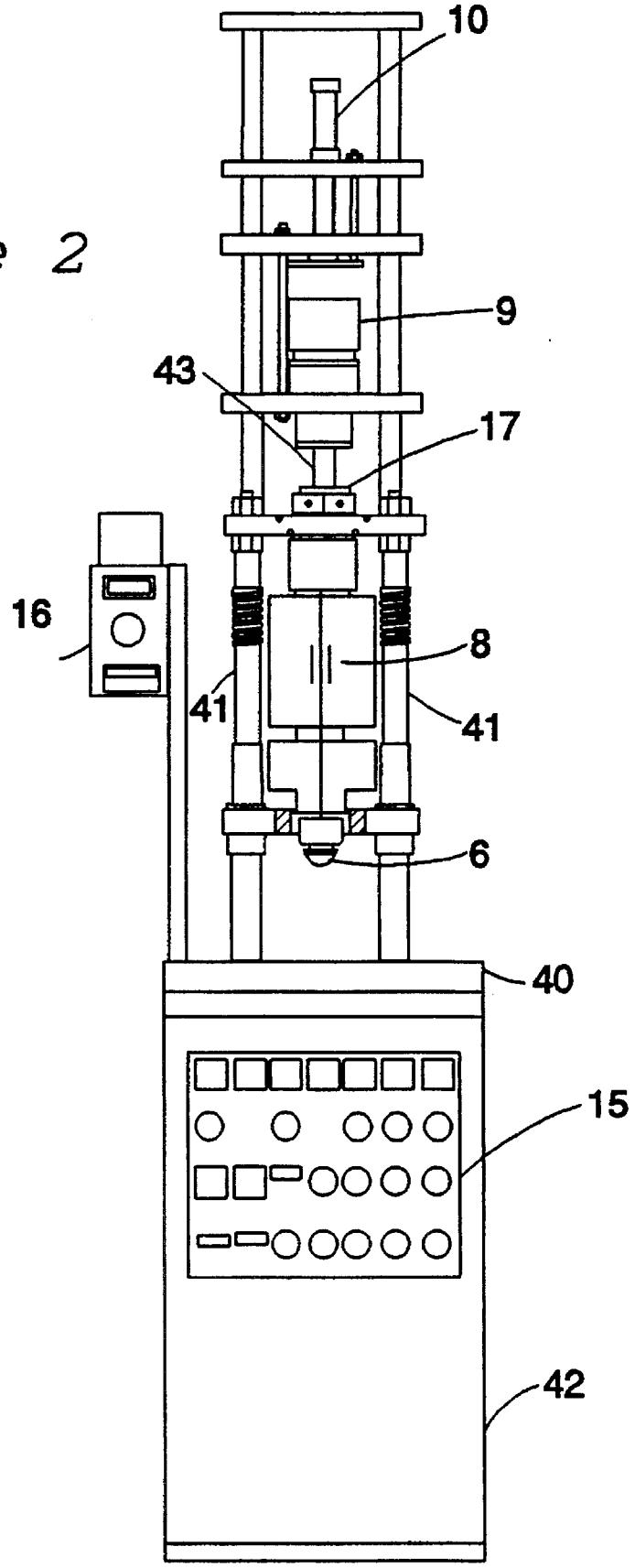
FIG. 2 shows a front view of the apparatus of the invention

A special SSM injection-molding machine (rheomolding-"machine), has been designed and constructed for casting semi-solid metal in a permanent mold to produce low-porosity complex SSM components continuously with a short cycle time as is done in the injection molding of plastics. FIGS. 1 and 2 show the machine of the invention from the side and front, respectively. Identical reference numbers in the two figures denote identical parts.

The physical structure of the rheomolding machine is similar to that of a plastic injection-molding machine, although a vertical arrangement is used rather than the horizontal design most common in plastic injection molding. The apparatus is built upon a base (40), upon which the mold is placed, which in turn is mounted upon a damping unit (42). Vertical tie bars (41) serve to support the operational parts of the unit. The control panel (15) and power supply/control units (13) are conventional.

A hopper (1) is provided for the raw material, which is maintained in a molten state by heater bands (2). An inert protective gas, such as Nitrogen or Argon, can be injected over the molten metal through appropriate piping (3) to drive out any air which might become entrained in the molten metal.

The operational parts of the apparatus are, from bottom to top, the nozzle (6), which serves to feed the semi-solid material to the mold (not shown), the zero-compression screw shearing/cooling unit (8), with seals (17) to contain the material in the shearing/cooling area while allowing the shaft of the screw (43) to connect to a motor (9) which rotates the screw, and also to permit the screw shaft (43) to slide up and down freely. The motor is preferably hydraulic. The motor (9) and screw shaft (43) can be moved up and down by a hydraulic ram (10), which is fed by hydraulic fluid by hose (11). A hydraulic bladder accumulator (12), which feeds the hose (11 ) is pressurized by the hydraulic pump and tank unit (14). The use of an accumulator allows the shaft to be moved more quickly, which is required for rapid injection of the semi-solid material into the mold. Control thermocouples (5) are provided as necessary to maintain accurate temperature control, as will be discussed below.

Figure 3:
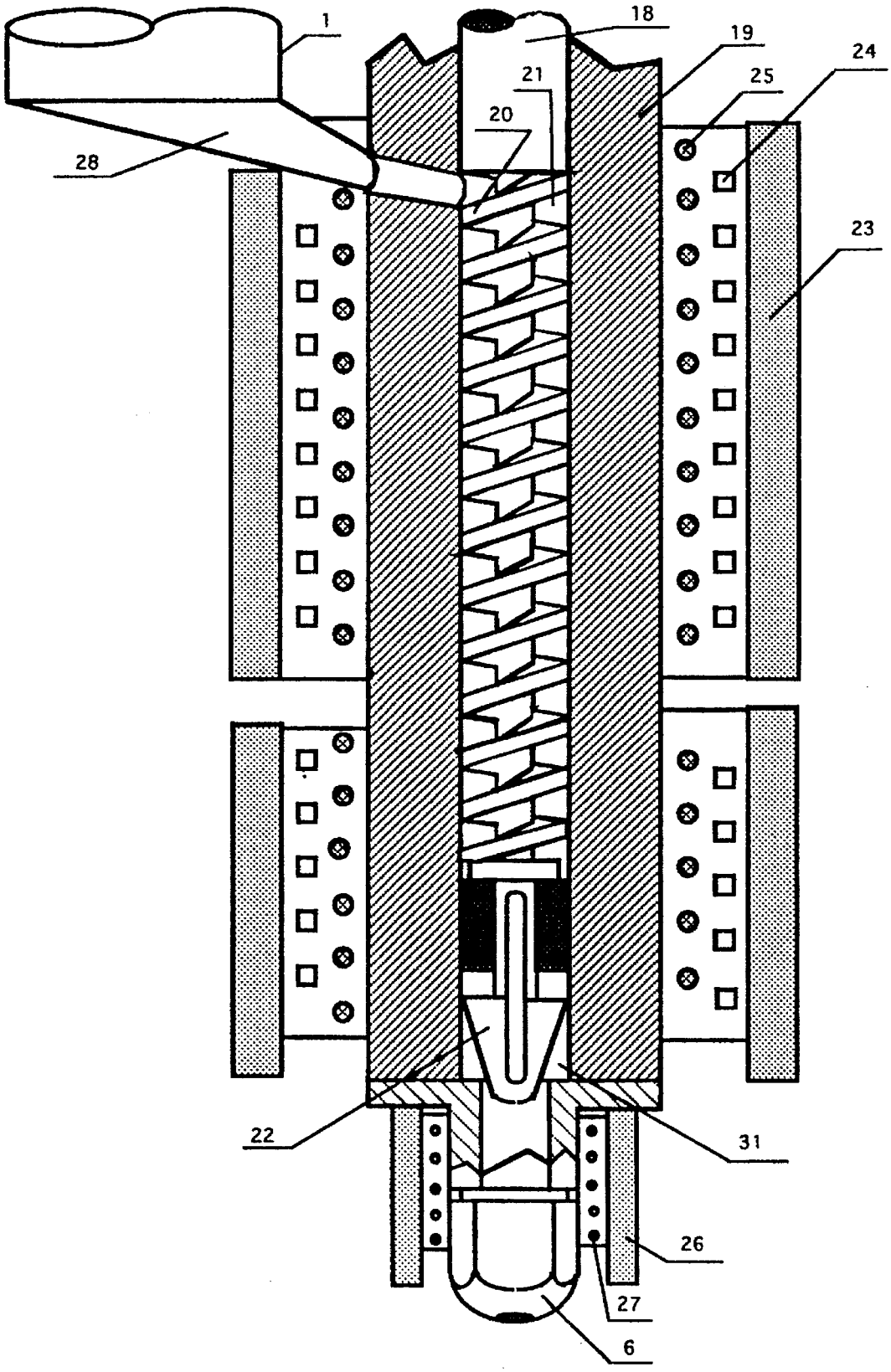
FIG. 3 shows a cut-away detail of the shearing/cooling section of the apparatus of the invention.

FIG. 3 shows the internal details of the shearing/cooling section of the apparatus ((8) in FIGS. 1 and 2). The hopper (1) connects through a duct (28) with the upper end of the barrel (19) cavity, at the level of the upper end of the screw (18) when it is fully lowered.

The screw (18) is shown in its fully "down" position in the barrel (19), with the non-return valve (22) at the end of the screw (18) occupying the accumulation zone (31) at the end of the screw cavity, in contact with the nozzle assembly (6). The screw (18) is a non-compression type, having flights (20) and inter-flight gaps (21) of even spacing along its length. There is a small gap, approximately 0.0254 ram, between the screw flights (20) and the inner wall of the barrel (19). The barrel (19) is surrounded by heating coils (25) and cooling ducts (24), which are in turn surrounded by insulation (23). The nozzle area is also surrounded by heating coils (27) and insulation (26).

Figure 4:
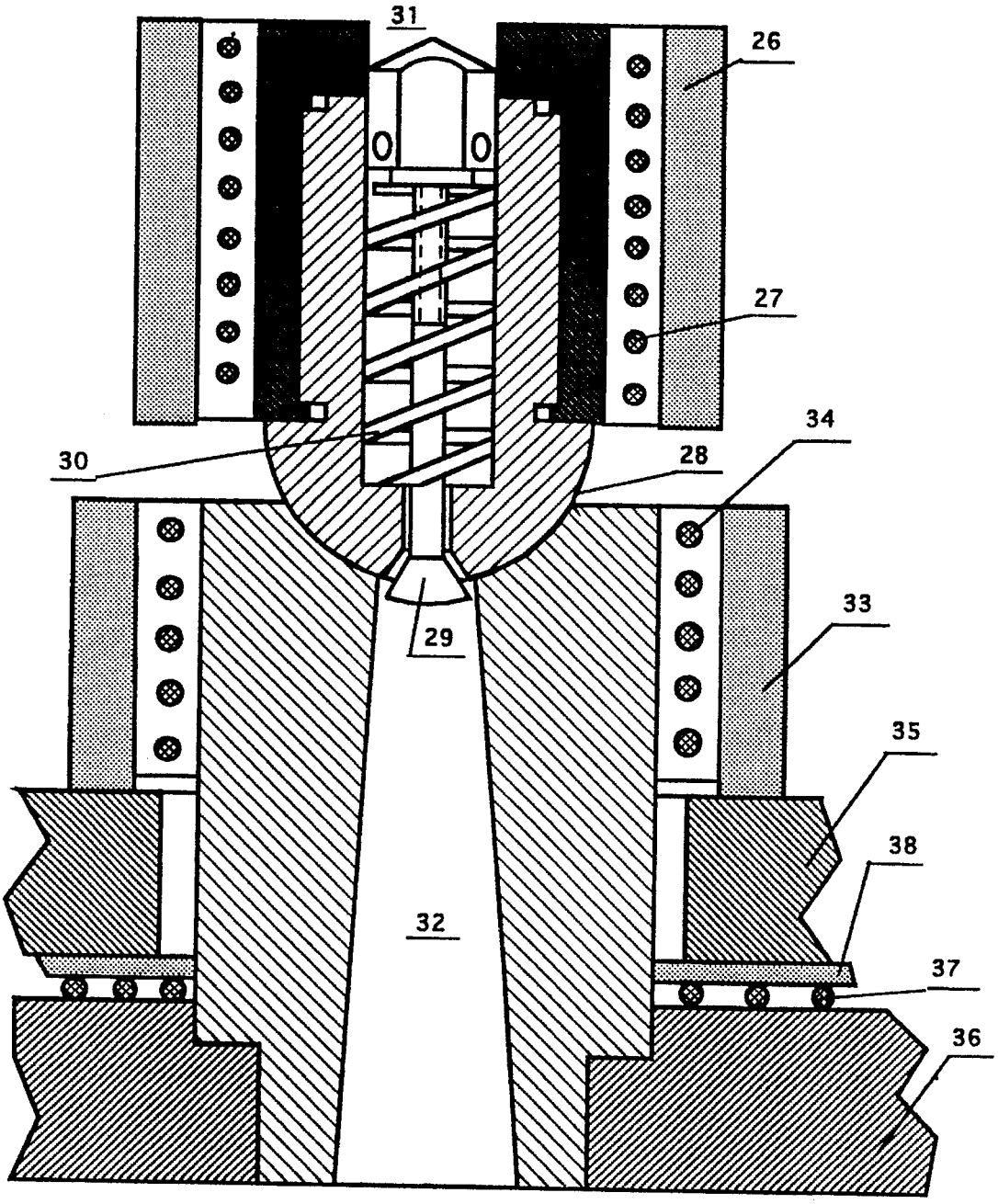
FIG. 4 shows a cut-away detail of the nozzle end of the injector of the invention, as well as part of a mold which could be used with the invention.

FIG. 4 shows the nozzle end of the shearing/cooling section. As noted above, the nozzle (28) area is surrounded by heating coils (27) and insulation (26). The accumulation zone (31 ) of the shearing/cooling section communicates with the nozzle (28), the end of which is selectively plugged with a valve pin (29), biased closed with a spring (30).

The mold is in two halves, (35) and (36), and has its opening for inflow of material at (32). The mold is also temperature controlled through heating elements (34) inside insulation (33). There is also insulation (38) and heating elements (37) between the two mold halves. Thermocouples are provided where appropriate for temperature monitoring and control.

Figure 5:
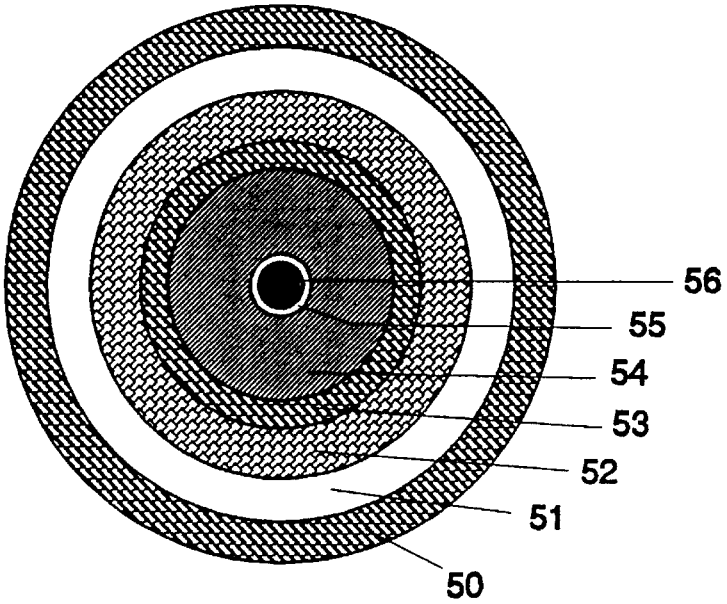
FIG. 5 shows a cross-section of the heat transfer system used in the shearing/cooling section of the apparatus of the invention.

It is well known that temperature control in a cooling process as used by the invention is much more difficult and requires more accuracy compared with the heating process used by Thixomolding and other prior art methods. Referring to FIG. 5 for a cross-sectional view, the barrel (54) temperature is accurately controlled by the integrated heating-and-cooling barrel jackets (with cast-in heating elements and cooling tubes).

In order to achieve fast response and accurate temperature (or cooling-rate) control, a new thermal jacket has been designed for the shearing/cooling zone of the apparatus. As shown in the cross-section view of FIG. 5, the jacket includes, from outermost to innermost layers, an outer jacket of cast material (50), preferably including an insulating material to minimize the effect of the ambient temperature. Inside this layer is a cooling layer for cooling fluid (51), which can be gas or liquid (i.e. air, or water, oil or other coolants) at a constant temperature. Then, a heating layer of preferably electric heating elements (52), and then another cast material inner layer (53). This layer is preferably of a metal with high thermal conductivity, high melting temperature, and stable chemical properties. The barrel itself (54) is inside this inner cast layer (53), with a small gap (55) into which the feed material flows and is subjected to shear forces. The screw (56) occupies the innermost area.

It should be noted that the electric heating layer (52) should be located between the zone to be cooled (55) and the cooling layer (51). There are various types of heating elements available (rods, bands, tubes, etc.), and any can be used within the teachings of the invention. The basic concept of the thermal jacket is to pump the cooling fluid into the cooling zone (51) at a fixed temperature lower than the desired temperature for the feed material zone (55), and to compensate the extra heat loss by applying electric heating (52). Therefore, the apparatus can control the temperature accurately by taking advantage of automatic electric heat control, which can be done easily.

The primary control parameters in the process include: hopper temperature, barrel and nozzle temperature, cooling rate (material solidification rate) in the barrel, screw rotation speed (shear rate), blending time, injection speed, injection pressure, packing pressure, packing time, mold temperature and cooling time.

FIG. 6 shows a flowchart of the method of the invention, as practiced in the apparatus described above. The method starts with the screw fully down, as shown in FIG. 3, and assumes that the nozzle valve is closed and the screw flights are full of material. The screw is kept rotating throughout the process.

In the first step (60), fully liquid metal is released from the hopper into the shearing barrel. It flow into the inter-flight gaps and between the screw and the barrel inner wail. When the area has filled, the flow of material stops.

The "blending" stage in the operational cycle (61), in which the material is continuously sheared by the rotating screw and cooled by the cooling medium in the barrel jacket, is a key to the effectiveness and efficiency of the production of semi-solid materials. From the processing point of view, the optimized process is the one in which the finest grain (thus the best mechanical properties) can be produced with the highest solidification ram (thus, the shortest cycle time) and the lowest shear rate (thus the lowest power consumption) in the barrel. A series of test experiments has been performed to decide the appropriate values of the control parameters. The microstructure of samples from different processing conditions are compared and the appropriate processing window for generating a fine nondendritic structure in the Sn-15% Pb alloy has been identified.

When the molten metal flows into the small gap between screw flights and the barrel (55), it is vigorously sheared (shear rate ±200/sec) and rapidly cooled, with an appropriate amount of latent heat being removed by the cooling medium circulating in the cooling tubes (51). The material becomes semi-solid with fine spherical crystals. Since the coolant temperature is always below the preferred material temperature, the heating elements are controlled to compensate the excessive amount of heat removal and maintain the required material temperature. The apparatus is-designed such that the screw will rotate without retraction in the "blend" mode, when a shearing force is applied to the material as it is cooled.

The temperature control in the barrel and nozzle is one of the most critical factors in the rheomolding process because when the temperature changes by 1° C. in the rheomolding of the Sn-15% Pb alloy with solid weight fraction ($f_s$) in the range of 0.3–0.5, the solid fraction will change by 3.2 to 9.9%. Therefore, temperature control with accuracy of +0.5° C. or smaller is essential in the rheomolding machine design.

FIG. 9 shows the temperature curve for the shearing/cooling zone, as it is set for the Sn-15% Pb alloy used in the example, with a solid fraction ($f_s$) of around 0.3 to 0.4. At the hopper outlet (90), where the molten metal flows into the shearing/cooling zone, the metal is at 225° C., above the liquidus temperature of the alloy (211° C.). As the material flows downward along the screw, through (91) it cools below the liquidus temperature at (92), and continues to cool through (93) and (94). The nozzle (95) is heated slightly above liquidus to avoid plugging, and the mold area (96) is once again below liquidus, as the material solidifies in the mold.

The screw rotates and retracts in the "load" step (62), when the prepared SSM of the prescribed shot size is pushed forward toward the accumulation zone in front of the screw (31). Since the viscosity of molten or semi-solid metals is several orders lower than molten polymers, a simple but effective design of a spring-loaded shut-off nozzle (see FIG. 4) is used to block the material from flowing out of the nozzle (due to gravity) during barrel loading in the vertical machine.

In the final step (4), the screw is quickly pushed downward by the hydraulic ram to open the spring-loaded valve in the nozzle and inject the material into the mold. The non-return valve at the end of the screw keeps the material from flowing upward past the screw.

The preliminary experimental results show that the method and apparatus of the invention is effective and efficient in producing SSM samples. Since the charge material in the hopper is in the liquid state, the air mixed in the material can be minimized, especially with the protective gas injection.

From the observations of a series of short shots from the rheomolding experiments, clearly the flow field, strongly affected by inertial effects, is still in the laminar flow regime and thus the porosity caused by turbulence is reduced. The thermal shrinkage of the parts will be reduced because of the lower latent heat contents in the SSM and thus the shrinkage porosity will be reduced as well. This means that the porosity of rheomolded parts will be dramatically reduced compared to pressure die-cast parts.

As the porosity can be practically eliminated and the warpage is small, it is very possible that net-shape die casting can be achieved with the proposed process. Although the final cost of each part made by this process cannot be estimated at this moment, it is believed that high-quality metal parts can be manufactured at lower cost with the proposed net-shape manufacturing process.

EXPERIMENTAL AND NUMERICAL RESULTS FOR A SPIRAL MOLD

Some experiments have been performed with a steel spiral mold. The half thickness of the mold is 1.5 mm, and the full width is 15 min. Two pressure transducers were flush-mounted at two down-stream positions in the cavity. Mold temperature was controlled by a water temperature-control unit. Temperatures (at hopper, barrel, nozzle and entrance of the spiral), ram position, screw-rotation speed, screw hydraulic pressure and pressure readings in the cavity were recorded by using a data-acquisition system.

The Sn-15% Pb was blended with an estimated shear rate of 200 $sec^{-1}$. The injection volume flow rate was set at $1.128\times10^{-4}$ $m^3$/sec; the whole spiral would be filled in 0.1 second at this injection speed. However, due to the rapid cooling and solidification in the mold, the filling stage stopped (i.e., short shot occurred) whenever the maximum pressure of the machine was reached.

The microstructure of the rheomolded spiral samples under different processing conditions were examined, and the results confirmed that the rheomolding machine can effectively break dendrites in the semi-solid slurries.

FIGS. *7a–c* show the microstructure of the rheomolded Sn-15% Pb at solid fractions ($f_s$) 0 (FIG. *7a*), 0.22 (FIG. *7b*) and 0.42 (FIG. *c*), to illustrate the crystal formation in the rheomolding process. Compared with the dendritic structure formed from injecting molten metal ($f_s$=0) into the mold (FIG. *7a*), crystals are mostly particle-like with few dendritic fragments at low solid fractions (FIG. *7b*). The rounding effect becomes even stronger at higher solid fractions, such that the crystals become more spherical and uniform (FIG. *7c*). From the observations, we found that the crystal-growth mechanism in the rheomolding process is similar to that under simple shear flow in the coaxial cylindrical viscometer experiments (Wang, N., Shu, G. and Yang, H. "Formation and Growth of Solid Particles in Shear Flow", *Journal of Materials Science,* Vol. 25, pp.2185–2187 [1990] ), except that stronger shearing force (which leads to smaller round crystals at high solid fractions) is expected in the rheomolding process.

FIG. *7c* is further examined for the distribution of primary crystals in the cross section, as shown in FIG. 8. It is seen clearly the primary crystals concentration in the central core near the outer side of the spiral. More specifically, in the gapwise direction, there is a distinct layer near the wall which contains almost no solid particles at all.

This phenomenon is caused by shear-induced diffusion since the gap thickness is rather thin and the shear rate at the wall is very high. Across the width, most of the primary crystals-are found at the outer side of the sample and almost no spherical particles at the inner side (not shown in FIG. 8).

Flow marks starting near the inner side of the 180° elbow and extending toward the central region in the flow direction were also observed. As mentioned above, the velocity and temperature near the outer region of the 180° elbow are low, such that most of the slurry has to squeeze through the narrowing gap near the inner side. As a result, the shear rate is high at the inner side and low at the outer region.

This shear-rate gradient is believed to be the cause of the segregation of the primary solids and the liquid matrix, as observed in FIG. 8. Also, due to this high shearing near the end of the filling stage, some of the solidified but soft material on the mold surface may have been dragged by the slurry along the flow direction. The flow marks are therefore caused by the friction when the solidified material slips on the mold surface at high pressure.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

I claim:

1. An injection molding machine for casting metals in semi-solid form, comprising:

a) a hopper for liquid metal, having means for maintaining the metal at a temperature above the liquidus temperature and a fluid outlet for liquid metal at the lower end thereof, b) a vertical shearing/cooling section comprising i) a solid tubular barrel having lower and upper ends, an axial cavity in the center, and a fluid input near the upper end thereof for inlet of liquid metal connected to the fluid outlet of the hopper, ii) a screw located in the axial cavity of the barrel, having a shaft extending out of the upper end of the barrel, having a length less than the length of the barrel, and fitting in the axial cavity with only a small gap between the screw flights and the walls of the axial cavity, capable of rotational motion and axial motion from a first position in which the lower end of the screw is near the lower end of the barrel, to a second position in which the upper end of the screw is near the upper end of the barrel, iii) a nozzle for mating with a mold, sealably located in the lower end of the axial cavity, having a fluid passage from the axial cavity to the lower end of the nozzle which mates with the mold, iv) seal means for preventing liquid metal flow while permitting the screw shaft to rotate and move up and down, located around the screw shaft on the upper end of the axial cavity, v) temperature control means for maintaining the barrel at a temperature below the liquidus temperature of the metal, c) means for rotating the screw, connected to the screw shaft, d) means for moving the screw lengthwise from its first position to its second position, connected to the screw shaft, the machine operating such that the liquid metal is fed into the shearing/cooling section while the screw is in its first, lower position and is sheared by the rotating screw while being cooled below its liquidus temperature under the control of the temperature control means and forming a semi-solid material; the rotating screw is moved to its second, upper position; and the screw is quickly moved to its first, lower position, ejecting the semi-solid material through the nozzle into the mold.

2. The molding machine of claim 1, in which the hopper is filled with protective gas above the liquid metal.

3. The molding machine of claim 2, in which the gas is selected from the group comprising Nitrogen or Argon.

4. The molding machine of claim 1, in which the means for rotating the screw is a hydraulic motor.

5. The molding machine of claim 1, in which the means for moving the screw lengthwise is a hydraulic ram.

6. The molding machine of claim 5, in which the hydraulic ram is moved quickly downward with pressurized fluid from an accumulator.

7. The molding machine of claim 1, in which the screw is non-compression.

8. The molding machine of claim 1, in which the screw has a non-return valve at the lower end thereof to prevent liquid flow upward along the screw as the screw is moved from its upper to its lower position.

9. The molding machine of claim 1, in which the means for temperature control of the shearing/cooling section comprises:

a) heating means surrounding the barrel, b) cooling means surrounding the heating means, such that the cooling means operates at a fixed temperature below the liquidus temperature of the metal, and the heating means is operated to raise the temperature of the barrel to the desired final temperature.

10. The molding machine of claim 9, in which the heating means comprises electrical heating coils.

11. The molding machine of claim 9, in which the cooling means comprises conduits filled with a cooled fluid.

12. The molding machine of claim 11, in which the fluid is water.

13. The molding machine of claim 11, in-which the fluid is air.

14. The molding machine of claim 1, in which the nozzle further comprises a shutoff valve.

15. The molding machine of claim 14, in which the shutoff valve is a spring-loaded valve biased to be normally closed, but to open and allow the semi-solid metal to flow when the screw is being moved from its upper to its lower position.

16. The molding machine of claim 1, in which the nozzle further comprises temperature control means.

17. The molding machine of claim 16, in which the temperature control means is heating means for heating the nozzle above the liquidus temperature of the metal.

18. The method of injection molding semi-solid metals, comprising the steps of:

a) starting with metal above its liquidus temperature, b) shearing the metal with a rotating, vertical, non-compression screw agitator, c) cooling the metal while it is being sheared, to a semi-solid state below its liquidus temperature, d) raising the screw agitator, causing the semi-solid metal to accumulate below the screw agitator, e) quickly lowering the screw agitator to inject the accumulated semi-solid metal into a mold.

19. The method of claim 18 in which the starting metal is maintained in a hopper filled with a protective gas.

* * * * *

UNITED STATES PATENT AND TRADEMARK OFFICE

CERTIFICATE OF CORRECTION

PATENT NO. : 5,501,266

DATED : March 26, 1996

INVENTOR(S) : Wang, et al

It is certified that error appears in the above-indentified patent and that said Letters Patent is hereby corrected as shown below:

Column 1, line 45, change "carded" to --carried--
line 61, change "et. at." to --et. al.--

Column 2, line 7, change "et. at." to --et. al.--
line 19, change "et. at." to --et. al.--
line 20, change "8 1976]" to --[1976]--

Column 3, line 36, change "injectionmolding" to --injection molding--

Column 4, lines 34 and 35, change "(rheomolding-"machine)" to --("rheomolding" machine)--

UNITED STATES PATENT AND TRADEMARK OFFICE

CERTIFICATE OF CORRECTION

PATENT NO. : 5,501,266

DATED : March 26, 1996

INVENTOR(S) : Wang, et al

It is certified that error appears in the above-indentified patent and that said Letters Patent is hereby corrected as shown below:

Column 5, line 19, change "0.0254 ram" to --0.0254 mm--

Column 6, line 23, change "inner wail" to --inner wall--
line 33, change "ram" to --rate--
line 51, change "is-designed" to --is designed--

Column 7, line 50, change "15 min." to --15 mm.--

Column 8, line 28, change "crystals-are" to --crystals are--

Signed and Sealed this

Nineteenth Day of November, 1996

*Attest:*

*Attesting Officer*

BRUCE LEHMAN

*Commissioner of Patents and Trademarks*